United States Patent [19]

Sakakura et al.

[11] Patent Number: 4,977,428

[45] Date of Patent: Dec. 11, 1990

[54] SYSTEM FOR DRIVE CONTROL OF TONER AGITATOR IN IMAGE-FORMING APPARATUS

[75] Inventors: Shigeki Sakakura, Tama; Nobuyuki Hayashida, Hachiouji, both of Japan

[73] Assignee: Fujitsu Limited, Kawasaki, Japan

[21] Appl. No.: 356,450

[22] Filed: May 24, 1989

[30] Foreign Application Priority Data

May 25, 1988 [JP] Japan ..... 63-129365

[51] Int. Cl.[5] ..... G03G 15/06

[52] U.S. Cl. ..... 355/245; 118/653; 310/198; 318/685; 355/208; 355/246

[58] Field of Search ..... 355/245, 246, 208, 250, 355/252; 118/653; 310/198; 318/685

[56] References Cited

U.S. PATENT DOCUMENTS

| | | | |
|---|---|---|---|
| 3,599,604 | 8/1971 | Chawda et al. | 355/245 X |
| 4,423,948 | 1/1984 | Kimura et al. | 355/246 |
| 4,473,028 | 9/1984 | Ito et al. | 355/245 X |
| 4,673,855 | 6/1987 | Boillat | 318/685 X |
| 4,714,867 | 12/1987 | Palmin et al. | 318/685 X |
| 4,734,737 | 3/1988 | Koichi | 355/246 X |
| 4,785,331 | 11/1988 | Oka et al. | 355/208 |
| 4,839,691 | 6/1989 | Tagawa et al. | 355/245 X |

*Primary Examiner*—A. T. Grimley
*Assistant Examiner*—Thu A. Dang
*Attorney, Agent, or Firm*—Staas & Halsey

[57] ABSTRACT

In an image-forming apparatus (1), such as an electrographic printer, in which an electro-static latent image formed on an photoconductive drum (5) is reproduced by a toner (15), having a pulse motor (M) for driving an agitator (13) built-in to a developer unit (8), the agitator (13) is controlled during an initialization process of the apparatus (1) by setting the rotational speed of the motor (M) at a lower level (P) upon a start-up thereof, and converting the same to a higher level (N) corresponding to the normal operational speed after a predetermined period (T1) has passed from the start-up, whereby a larger torque is generated from the motor (M) at the start-up stage of the initialization so that the agitator (13) can be smoothly rotated even if the toner (15) has solidified in the developer unit (8).

10 Claims, 20 Drawing Sheets

(PROCESS CARTRIDGE REMOVED)

SYSTEM FOR DRIVE CONTROL OF TONER AGITATOR IN IMAGE-FORMING APPARATUS

BACKGROUND OF THE INVENTION

1. Field of the Invention

The present invention relates to an image-forming apparatus, such as an electro-photographic printer or a copier, in which an electro-static latent image on an image carrying body is reproduced by a toner. More specifically, it relates to a system for controlling a drive of a toner agitator in such an image-forming apparatus at an initial stage of the operation thereof.

2. Description of the Related Art

As illustrated in FIGS. 1 through 4, an electro-photograph printer 1 comprises lower and upper frames 1*a*, 1*b*, and a process cartridge 2, transfer-charger 3, and fuser unit 4 mounted therein. The process cartridge 2 consists of a photoconductive drum 5 around which a developer unit 8, a precharger 7, and a cleaner 9 are arranged; all of these elements being built-in to a case 2*a* and forming a cartridge. A main motor M is provided in the lower frame 1*a* for driving the photoconductive drum 5, the fuser unit 4, and a plurality of rollers 6*a*, 6*b* for advancing a sheet 25. As shown in FIGS. 2 and 4, the process cartridge 2 is inserted into or removed from the interior of the printer 1 through an opening 17 formed between the lower and upper frames 1*a* and 1*b* when the upper frame 1*b* is separated from the lower frame 1*a* by a pivoting motion of the upper frame 1*b* about a pin 14.

In the printing operation, cut sheets 25 are fed one by one from a hopper 10*a* or 10*b* and transported by a plurality of rollers 6*a*, 6*b* into an area between the transfer-charger 3 and the photoconductive drum 5, then past the fuser unit 4 and are discharged on a stacker 12.

As shown in FIG. 5, the precharger 7, an LED-array 11, the developer unit 8, the transfer-charger 3, and the cleaner 9 are sequentially arranged around the photoconductive drum 5, and accordingly, during a counterclockwise rotation of the drum 5, the periphery thereof is uniformly charged by the precharger 7. Then the electro-static latent image is formed on the drum periphery by the LED-array 11 in accordance with information input and is reproduced as a toner image by the developer unit 8. Thereafter, the toner image is transferred to the surface of the cut sheet 25 by the transfer-charger 3 and fixed thereon by the fuser unit 4, and finally, the cut sheet 25 is discharged as a hard copy onto the stacker 12.

In this connection, the developer unit 8 accommodates an agitator 13 therein for stirring a powdery toner 15 filled in the unit 8 and delivering the same to a magnet roller 14, as shown in FIG. 5. The agitator 13 is also driven by the main motor M. In the conventional printer, the motor M is rotated at substantially the same speed at the warming-up stage of the printer as during a normal printing operation.

The powdery toner 15 filled in the developer unit 8 is liable to solidify when the process cartridge 2 is stored on a shelf for a long time, for example, more than one week or one month, or suffers from a vibration during transportation, whereby the apparent density thereof is increased from 30% to 40%. If the process cartridge 2 in which the toner is solidified is initially set on the printer, the agitator 13 is subjected to a larger rotational load at the warming-up stage of the operation, and this may cause damage to or deformation of the agitator 13.

In general, an initialization is carried out at the beginning of the printing operation to ensure a better printing quality. The initialization is made by energizing the elements of the printer for a short period, to initialize the printer conditions. The steps of the initialization process are sequentially checked by a control unit corresponding to the predetermined time schedule starting simultaneously with the switch-on of the motor. As stated before, if the toner has solidified, the rotation of the main motor M, which is substantially the only drive source for the rotating elements of the printer, is obstructed thereby at the beginning of rotation. Accordingly, the initialization schedule is delayed and an error signal is generated from the control unit.

The above drawbacks can be eliminated by the provision of a larger capacity motor which can overcome the resistance from the solidified toner, but such a larger motor is uneconomical, since the solidified toner can be restored to the required state by only one rotation of the agitator.

SUMMARY OF THE INVENTION

Accordingly, an object of the present invention is to eliminate the above drawbacks of the prior arts without using an uneconomical larger capacity motor.

Another object of the present invention is to provide a system for controlling a main motor for driving rotating elements of an image-forming apparatus, such as an electrographic printer, at the beginning of the operation thereof so that the main motor having a proper capacity for driving the elements during the normal printing operation is also applicable to the abnormal beginning stage.

According to the present invention, in an image-forming apparatus, such as an electrographic printer, in which an electro-static latent image formed on an image-carrying body is reproduced by a toner, comprising a main motor for driving substantially all rotating elements in the apparatus including an agitator built-in to a toner vessel of a developer unit, which toner vessel is removably attached to the apparatus; a system for controlling a drive of the agitator at a start-up of the apparatus is provided, which is characterized in that the rotational speed of the agitator is set at a lower level upon a start-up of the main motor, and is converted to a higher level corresponding to a normal operational speed after a predetermined period has passed from the start.

According to a preferable aspect of the present invention, the main motor is a pulse motor and a rotational speed thereof is set at a lower level at an initial stage of the operation thereof so that a larger torque is generated to drive the agitator, and is converted to a higher level after a predetermined period has passed.

The predetermined period for which the rotational speed of the motor is set at the lower level preferably corresponds to at least one rotation of the agitator.

BRIEF DESCRIPTION OF THE DRAWINGS

The other objects and advantages of the present invention will be more apparent from the following description made with reference to the drawings illustrating the preferred embodiments of the present invention: wherein

FIG. 15(*b*) is a partial enlarged back view of the mechanism of FIG. 15(*a*);

FIG. 17(*b*) is a side view of the gear mechanism of FIG. 17(*a*);

DESCRIPTION OF THE PREFERRED EMBODIMENTS

There are various ways of driving an agitator at a lower rotational speed at the initial stage of the operation of a printer. For example, an agitator may be driven by a vari-speed mechanism connected to a main motor so that the rotational speed of the agitator is adjustable through the vari-speed mechanism while the motor speed is maintained at a constant value. Alternatively, instead of using the vari-speed mechanism, the rotational speed of the main motor itself may be converted to either a lower or higher level. The following description of the present invention will be mainly of the preferred embodiment adopting the latter alternative.

Figure 6:
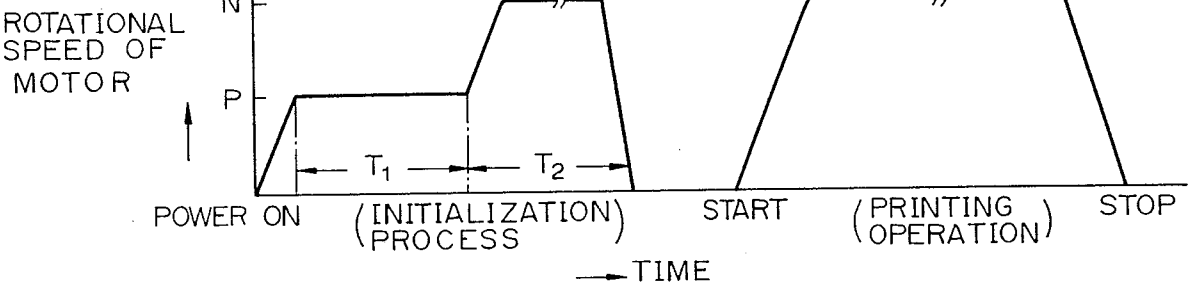
FIG. 6 is a time chart for explaining the operation of a pulse motor for driving an agitator according to the present invention.

When a fresh process cartridge in which a developer unit is built-in is fitted in a printer, as illustrated in FIG. 6, a main motor of the printer is rotated, upon input of a power source, and/or upon detection of insertion of the fresh process cartridge, at a lower rotational speed P for a first predetermined period T1, and then the speed is converted to a higher level N and continues for a second predetermined period T2.

Figure 7:
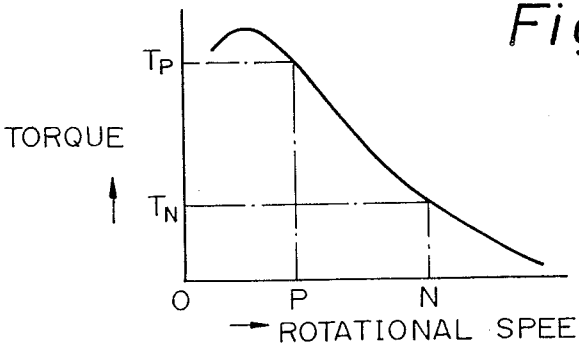
FIG. 7 is a characteristic curve illustrating a relationship between a rotational speed and a torque of a pulse motor.

As apparent from a characteristic curve of the main motor (pulse motor) shown in FIG. 7, the motor generates a larger torque when the rotational speed thereof is at a lower level than at a higher level. Accordingly, a larger torque Tp can be obtained by the lower rotational speed P in the first period T1 in which the agitator is subjected to a heavy load caused by a solidified toner. The rotational speed of the motor is elevated thereafter to normalize a rotational speed of the agitator to properly deliver the toner to a magnet roller. Since the toner has been sufficiently restored to the required condition at this stage, the motor can be smoothly rotated even with a lower torque Tn corresponding to the higher rotational speed N.

The sum of periods T1 and T2 is a time necessary for carrying out an initialization process of the printer conditions. The period T2, however, may be relatively short because the initialization process does not take long, and therefore, substantially no problem arises even if the motor is rotated at the lower level P in the second period T2 subsequent to the first period T1.

After the initialization, the printer is ready to start a printing operation. That is, the motor is rotated at the normal high rotational speed N every time an information signal is received so that the printer forms an electro-static latent image, and develops, transfers and fixes the same to produce a hard copy thereof.

Figure 8:
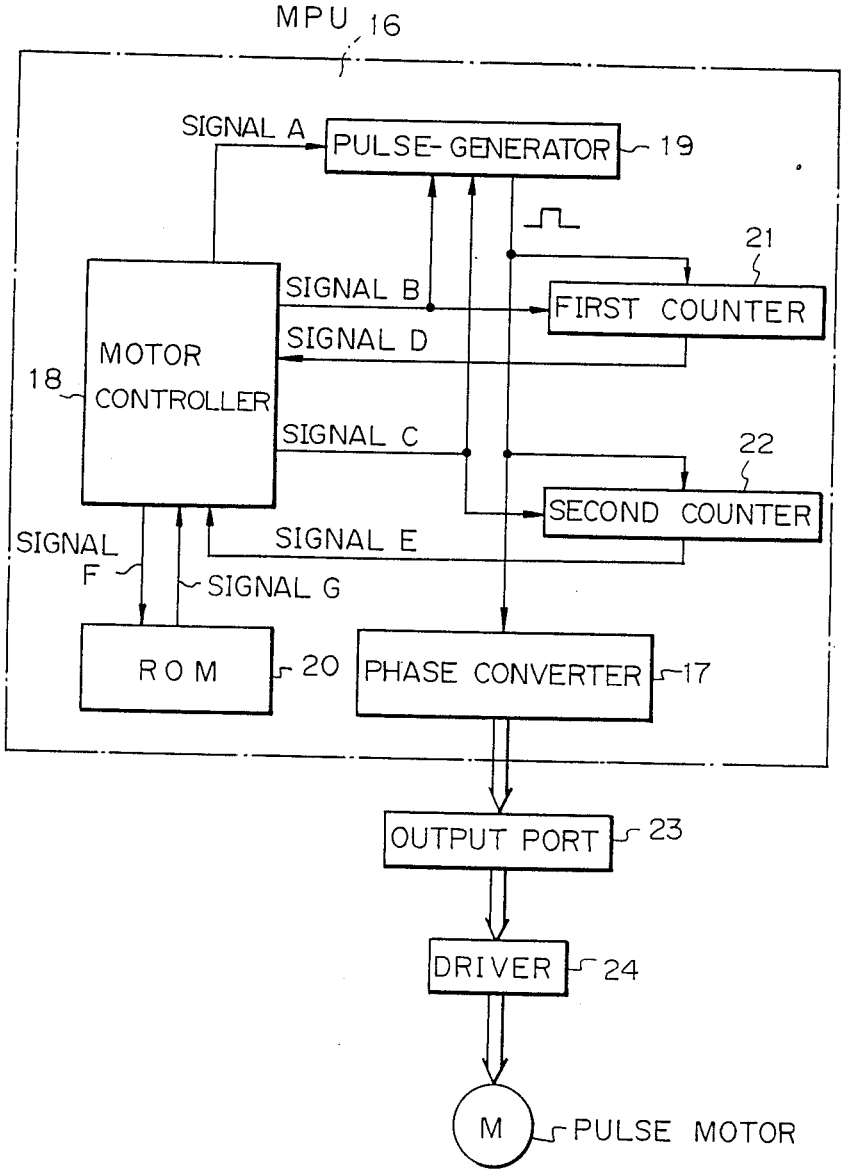
FIG. 8 is a circuit for controlling the rotational speed of a pulse motor according to the present invention.

FIG. 8 illustrates a circuit for controlling a rotational speed of a motor in the above manner. A microprocessor unit (hereinafter referred to as "MPU") 16 controls the motor M, preferably a conventional pulse motor, in accordance with a predetermined program. The MPU 16 is provided with a phase-converter 17, first and second counters 21, 22 for phase-conversion, a motor-controller 18, a pulse generator 19, and a ROM 20 holding data for the motor rotation.

The motor M is a single motor used for commonly driving substantially all rotating elements in the printer.

Next, the operation of the motor control circuit will be explained with reference to FIGS. 9(*a*) through 9(*d*).

As an indication signal is fed to the motor controller 18 through a conventional means (not shown) when the power source is input to the printer or when a sensor detects that the fresh process cartridge is inserted in the printer, the motor controller 18 issues a signal D to the ROM 20 to output the data for a low speed rotation of the motor, including a slewing data stored in the ROM 20, thereto as a signal G, which data, in turn, is input to the motor controller 18. Then the motor controller 18 outputs a signal B based on the data now input to the pulse generator 19 and the first counter 21. The pulse generator 19 generates a series of pulses in accordance with the signal B, as shown in FIG. 9(*b*), and the pulses thus generated are fed to the phase converter 17, and the motor M is started and taken from a zero rotational speed level to that of a low level P, by an output from the phase converter 17 via an output port 23 and a driver 24. In the example shown in FIGS. 9(*a*) through 9(*d*), the pulse pitch corresponding to the low rotational speed P is 1,000 pps.

The series of pulses from the pulse generator 19 is also fed to the counter 21, which has been made ON by the input of the signal B, and is counted thereby. If the counted number reaches a preset value corresponding to one rotation of the agitator, a count-up signal D is output from the first counter 21 to the motor controller 18.

The motor controller 18 then requests, in a similar manner as before, that the ROM 20 output the data for the high speed rotation of the motor, stored in the ROM 20 to the motor controller 18, and outputs a signal C based on the data now input to the pulse generator 19 and the second counter 22.

Figure 9:
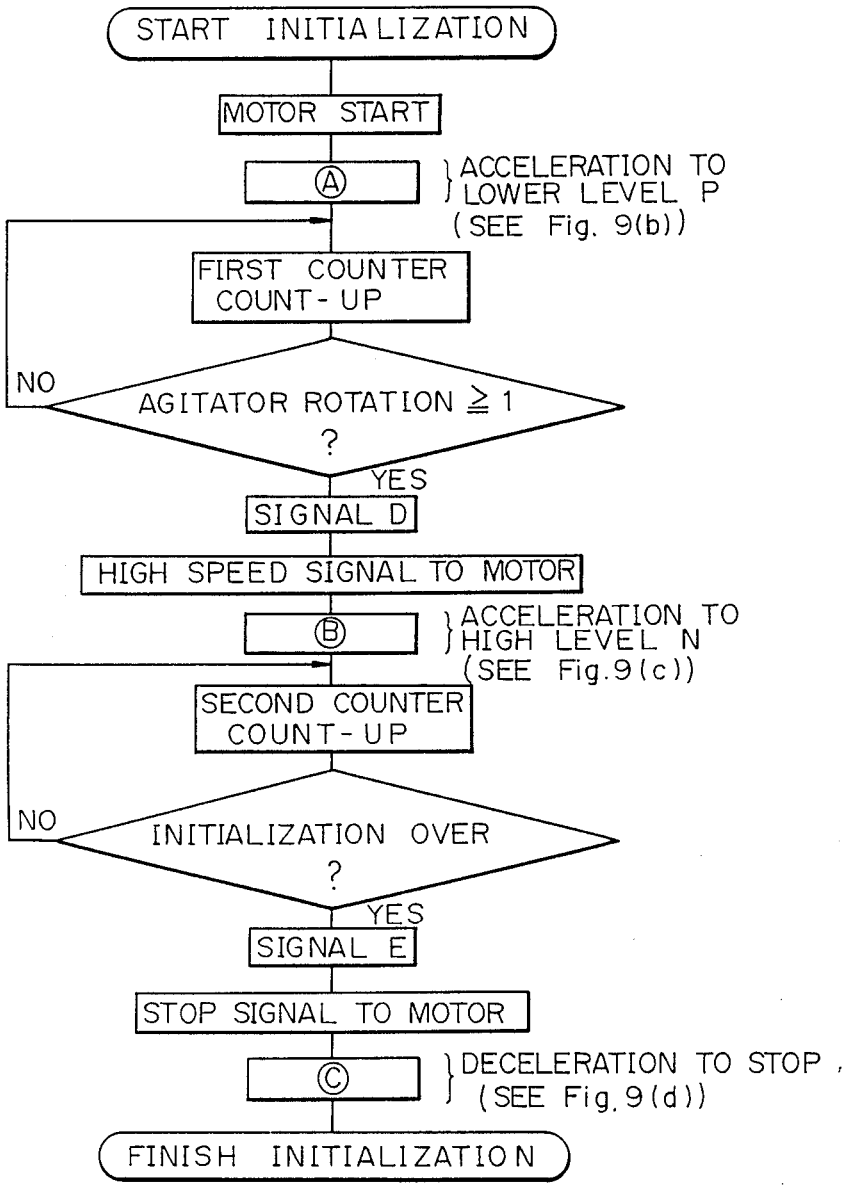
FIGS. 9(*a*) through 9(*d*) are a flow chart for explaining the operation of the control circuit shown in FIG. 8.
Figure 9B:
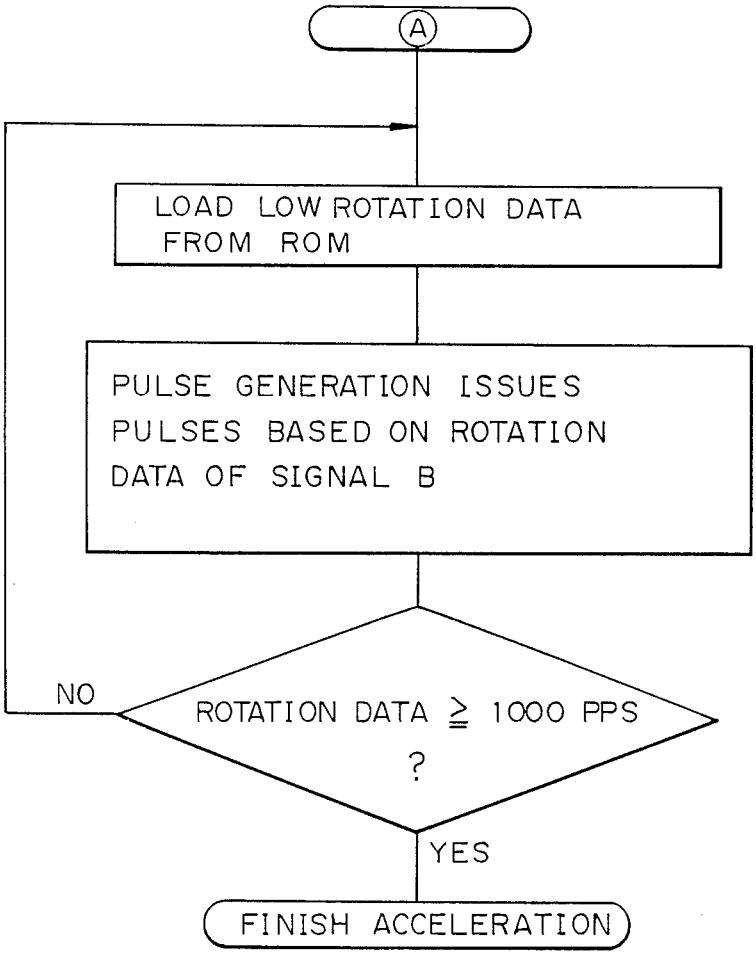
Figure 9:
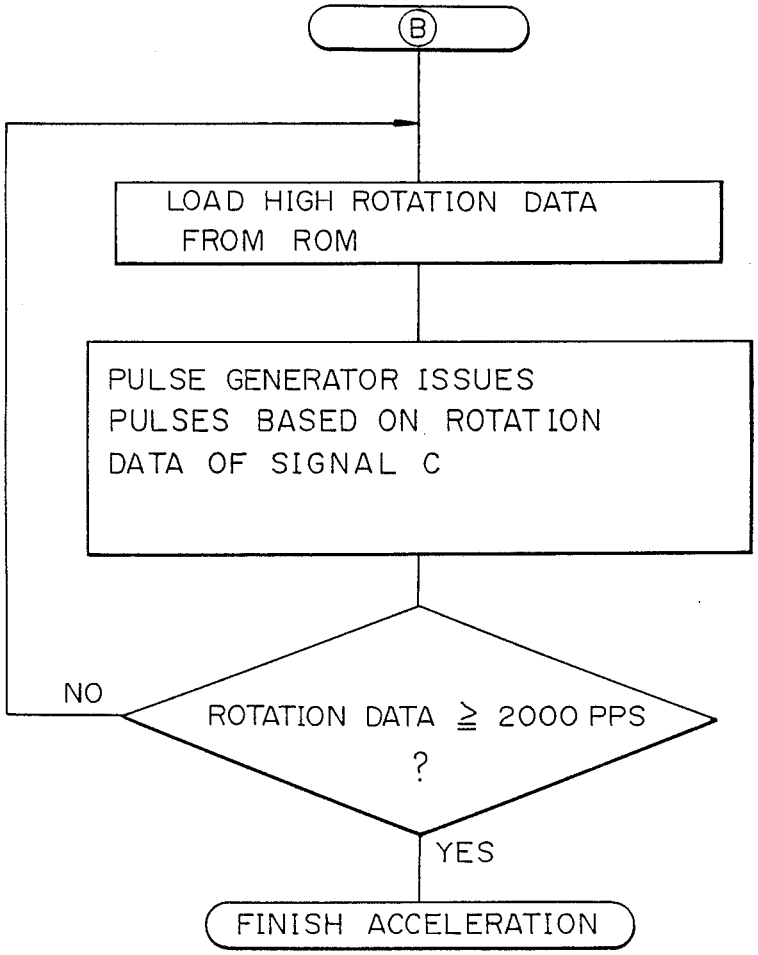
Figure 9:
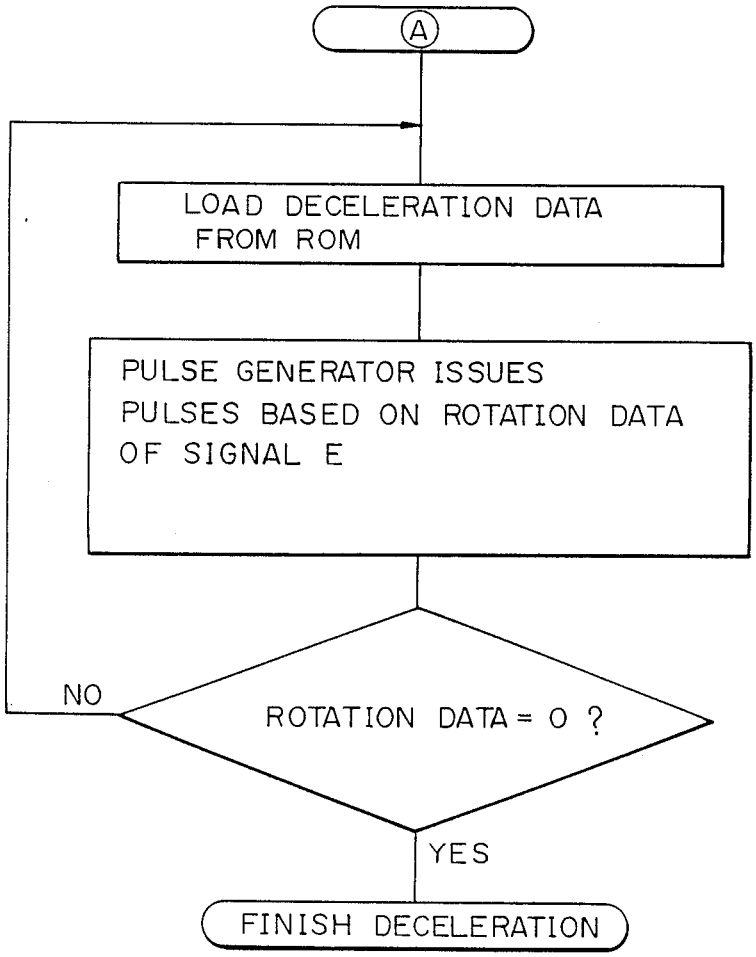
Figure 10:
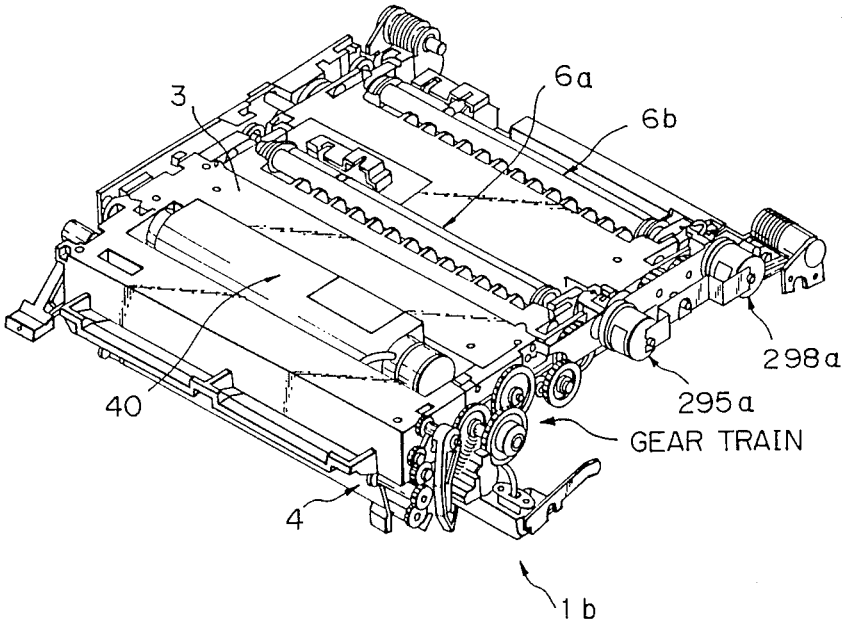
FIG. 10 is a perspective view of the upper frame.

The pulse generator 19 generates a series of pulses in accordance with the signal C, as shown in FIG. 9(*c*), and thus the motor M is accelerated from a rotational speed of a low level P to that of a high level N. In the example shown in FIGS. 9(*a*) through 9(*d*), the pulse pitch corresponding to the high rotational speed N is 2,000 pps.

The series of pulses from the pulse generator 19 is also fed to the counters 22, which has been made ON by the input of the signal C, and is counted thereby. If the counted number reaches a preset value corresponding to, for example, 17 rotations of the agitator, during which an initialization of the printer is carried out, a count-up signal E is output from the second counter 22 to the motor controller 18. Then the motor controller 18 controls the pulse generator 19 to gradually decelerate the motor rotation in accordance with a sequence shown in the flow of FIG. 9(*d*), and finally, outputs a stop signal A to the pulse generator 19, whereby the pulse generator 19 is made inoperative and the rotation of the motor M is thus stopped. Accordingly, the initialization process of the printer is finished.

The structure of a printer to which the present invention is preferably applied will be explained in more detail with reference to FIGS. 10 through 23, in addition to FIGS. 1 through 5.

Figure 1:
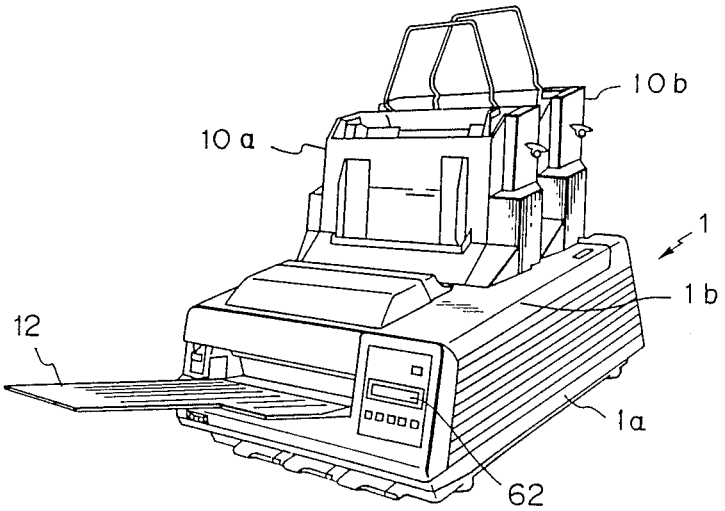
FIG. 1 is a perspective view of a printer to which the present invention is applied.
Figure 2:
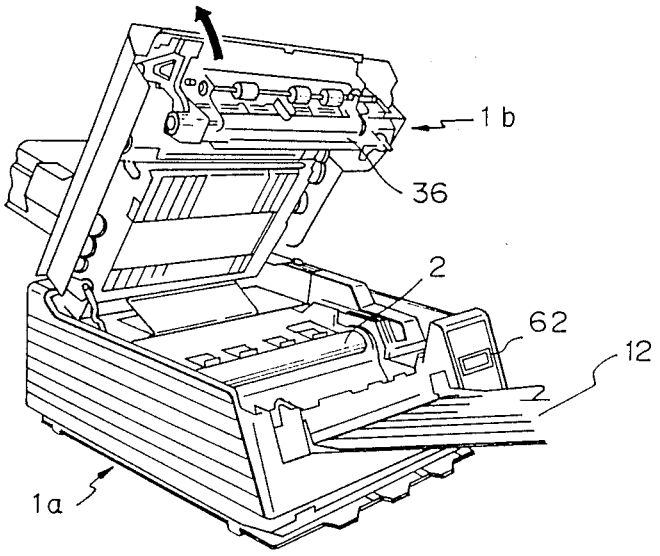
FIG. 2 is a perspective view of a printer shown in FIG. 1 when an upper frame is separated from a lower frame thereof so that an opening is formed.
Figure 4:
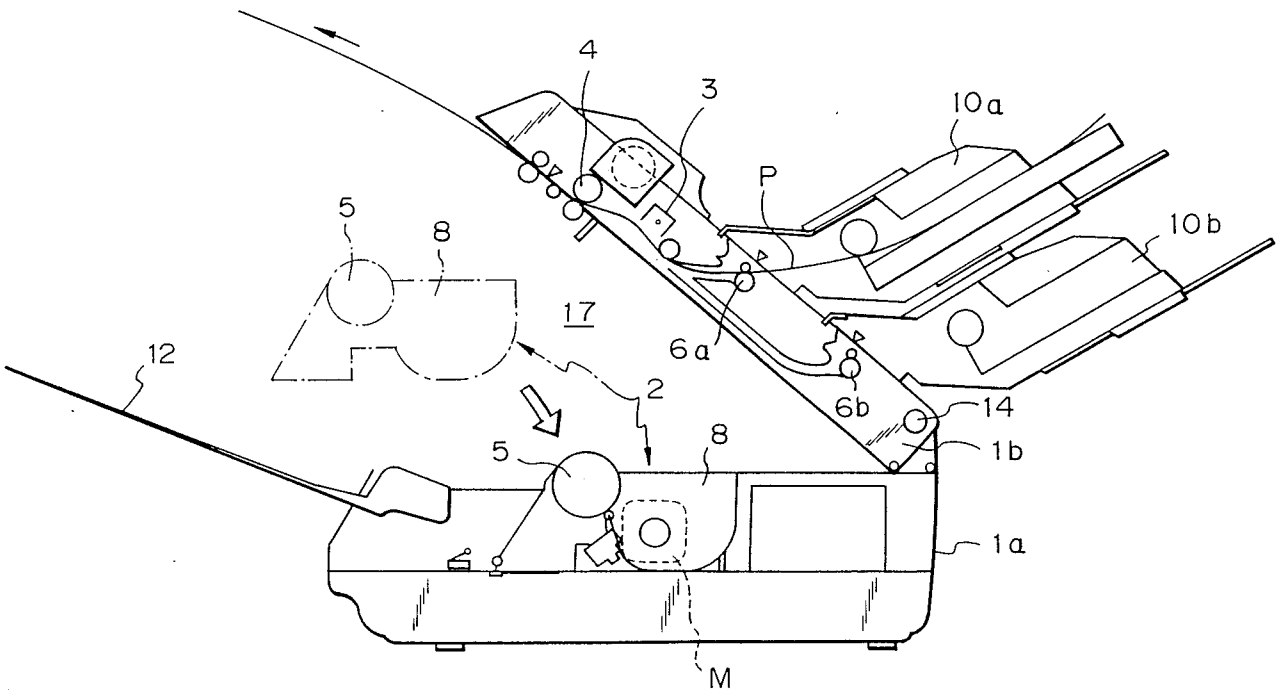
FIG. 4 is a schematic side view of the printer corresponding to FIG. 2.

The printer comprises a clam-shell type housing having an upper frame 1*b* and a lower frame 1*a* detachably connected to each other by a pin 14*a*, as shown in FIGS. 2 and 4. In the drawings, reference numeral 62 designates a control panel for controlling the operation of the printer and 12 designates a stacker for receiving a printed medium 25 (cut sheets).

Figure 3:
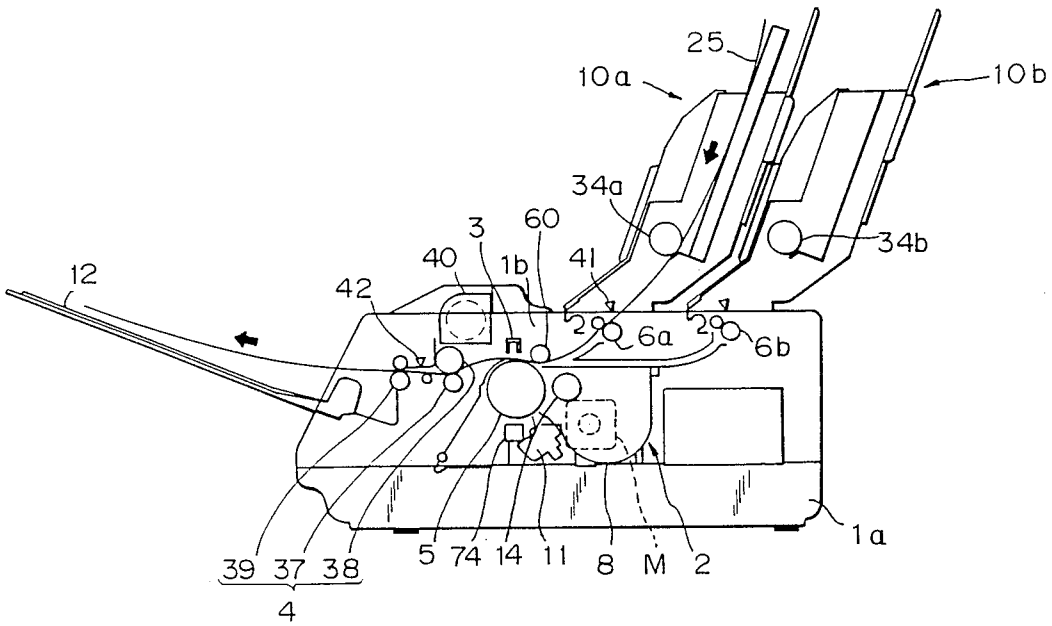
FIG. 3 is a schematic side view of the printer corresponding to FIG. 1.
Figure 11:
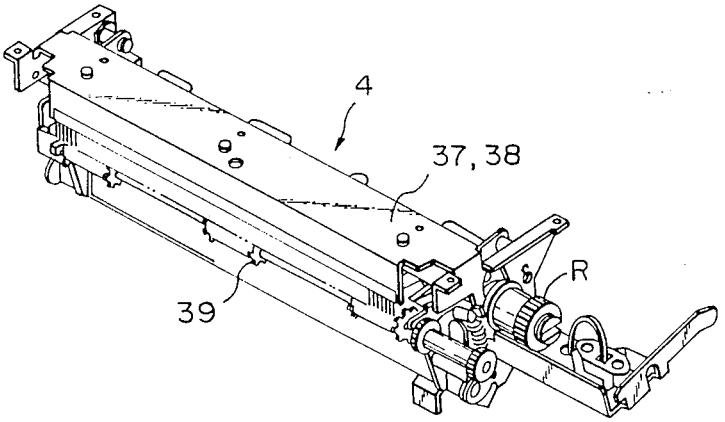
FIG. 11 is a perspective view of a fuser unit.

As apparent from FIG. 3, the upper frame 1*b* has a fuser unit 4, a cooling fan 40, an entry sensor 41, an exit sensor 42 and a transfer-charger 3. In addition, first and second hoppers 10*a* and 10*b* are detachably secured to the upper frame 1*b*. The hoppers 10*a* and 10*b* are provided, respectively, with pickup rollers 34*a*, 34*b*, which correspond, respectively, to regist rollers 6*a*, 6*b* secured to the upper frame 1*b*. Different kinds of cut sheets 25 can be accommodated in these hoppers, respectively. During the printing operation, either one of the hoppers is selected by the action of magnetic clutches 295*a*, 298*a* as stated later. As shown in FIGS. 3 and 11, a heat roller 37, a backup roller 38, and an eject roller 39 are all incorporated into the fuser unit 4.

Figure 12:
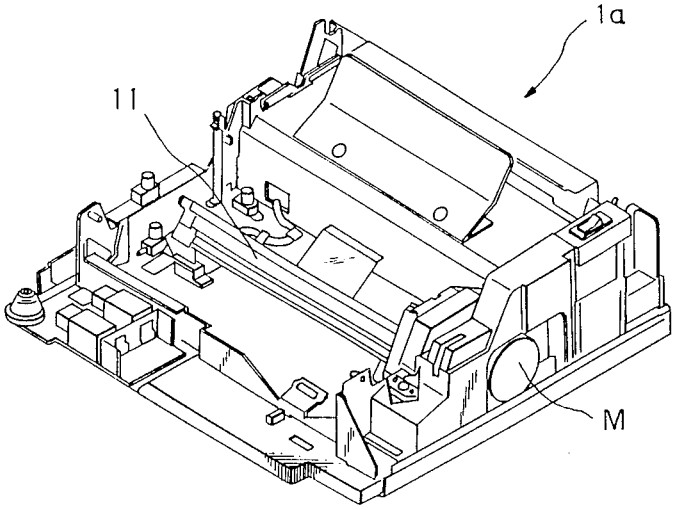
FIG. 12 is a perspective view of a lower frame.

As illustrated in FIGS. 2, 3 and 12, in the lower frame 1*a* are secured a process cartridge 2, an LED array 11, and a motor M which is a drive source for the rotating elements of the printer.

Figure 5:
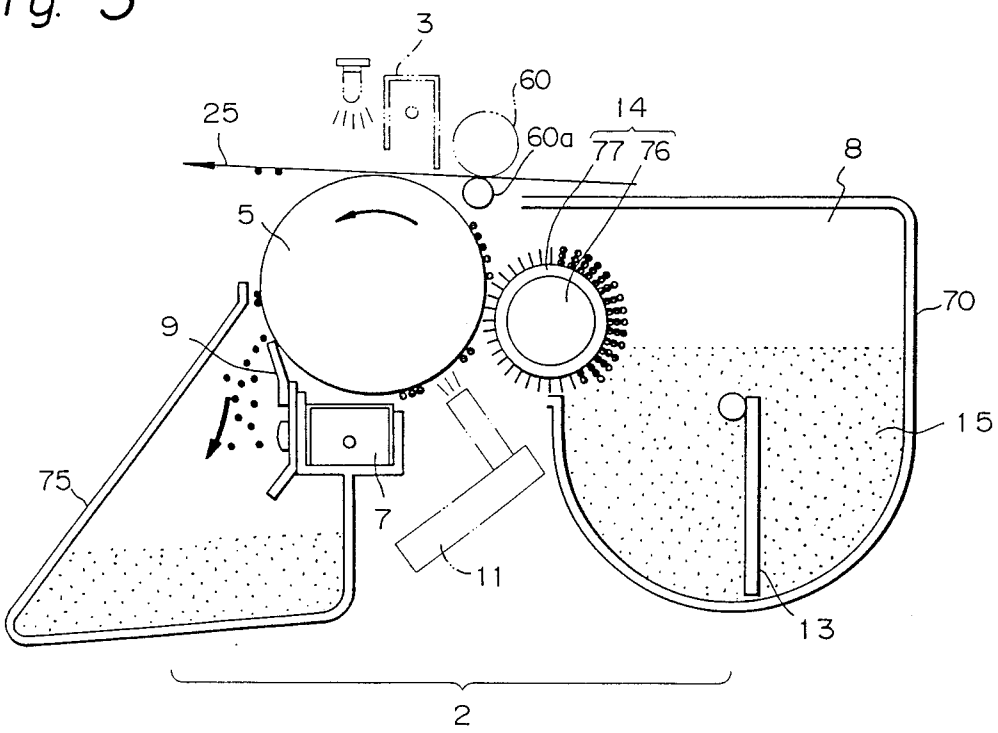
FIG. 5 is a schematic side view illustrating an internal structure of a process cartridge.
Figure 13:
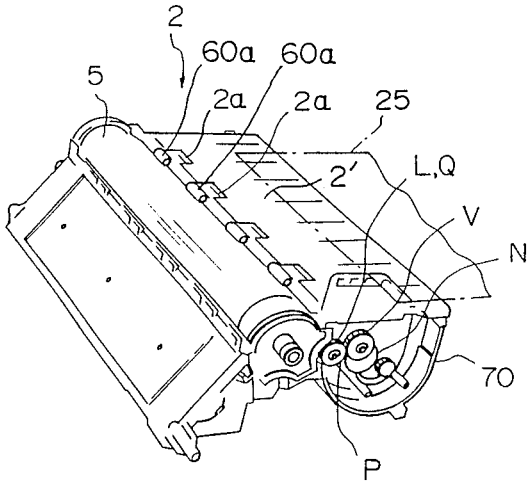
FIGS. 13(*a*) and 13(*b*) are perspective views, respectively, of a process cartridge.
Figure 13:
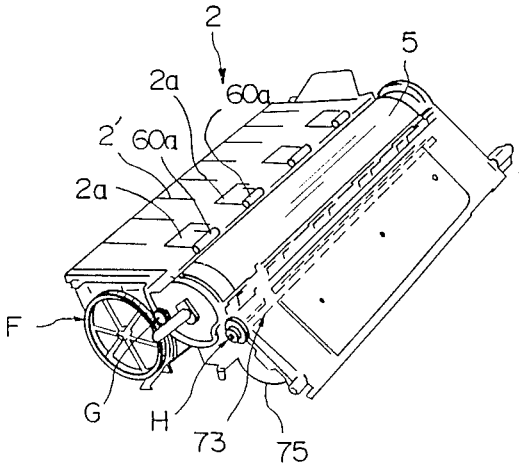

With reference to FIGS. 5 and 13, the process cartridge 2 is a composite body in which a developer unit 8 consisting of a toner vessel 70, an agitator 13, and a magnet roller 14; a precharger 7; a cleaner 9; a residual toner withdrawal vessel 75; and photoconductive drum 5 are integrally and compactly combined. The cartridge 2 is easily attached to and detached from the lower frame 1*a* by a push button mechanism. In the developer unit 8, a toner powder 15 in the vessel 70 is stirred by the agitator 13 and uniformly fed to the magnet roller 14. The magnet roller 14 consists of a magnetic core 76 and sleeve 77 covered thereon. The magnetic core 76 and the sleeve 77 rotate, respectively, at different speeds, so that the sleeve 77 can convey a toner powder onto the surface of the photoconductive drum 5 by a magnetic brush formed on the surface of the sleeve 77, which toner powder forms a toner image on the drum 5 corresponding to a latent image. The cleaner 9 is adapted to clean residual toner powder from the surface of the photoconductive drum 5 after the toner is transferred to the cut sheets 25. The precharger 7 is adapted to uniformly impart an electric charge to the surface of the photoconductive drum 5, to prepare for the next image forming cycle. An upper surface 2' of the process cartridge 2 constitutes a guide plate for the cut sheets 25. A pinch roller 60*a* is provided at a front edge of the upper surface 2' and brased upward by a blade spring 52*a* to be resiliently in contact with a guide roller 60 secured on the upper frame 1*b*. The cut sheet 25 can be introduced into an image-transfer zone formed between the drum 5 and a transfer-charger 3, while nipped between the pinch roller 60*a* and the guide roller 60.

A torque from the motor M is transmitted to the respective rotating elements in the lower frame 1*a* and the upper frame 1*b* through a gear box secured on one side of the lower frame.

Figure 14:
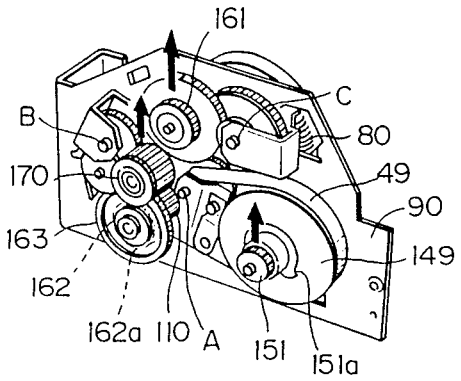
FIG. 14 is a perspective view of a gear box provided in the lower frame.

FIG. 14 shows the gear box with the cover removed therefrom, in which various gears and pulleys are secured on a bracket 90. The torque from the motor M is transmitted to a gear 162 from a motor gear 110. A gear 163 is coaxially secured with the gear 162, with the intervention of a one-way clutch 162*a* of the known spring type, so that only the counter-clockwise rotation of the gear 162 can be transmitted to the gear 163. Also, a one-way clutch 151*a* of the same type as the clutch 161*a* is intervened between a pulley 149 and a gear 151 secured coaxially therewith, which transmits only the counter-clockwise rotation of the pulley 149 to the gear 151.

In FIG. 14, the gear 151 is used for driving the photoconductive drum 5 in the process cartridge 2 and is biased about a shaft A in the arrowed direction by a spring (not shown). A gear 170 is used for driving a magnet roller 14 and is biased about a shaft B in the arrowed direction. Further, a gear 161 is used for transmitting a torque to a gear train for driving the rollers secured in the upper frame 1*b* and is biased about a shaft C by a spring 80. These three gears 151, 170, and 161 are key wheels for outputting a torque from the gear box.

Figure 15A:
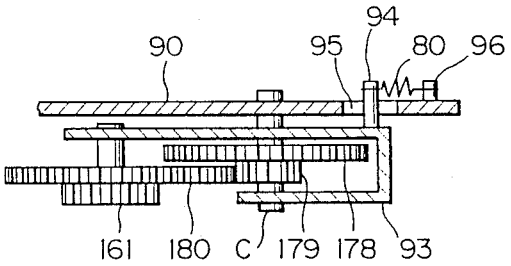
FIG. 15(*a*) is a plan view of a mechanism for ensuring an intermeshing of a gear in the gear box with a gear in the upper frame.
Figure 15B:
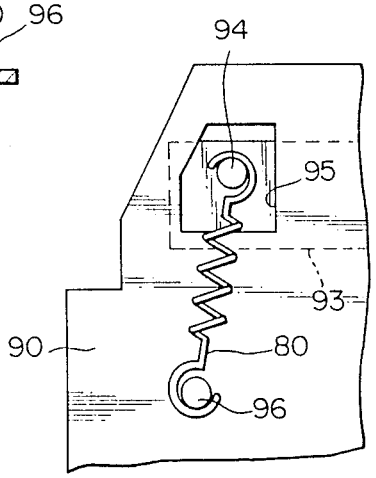

The above mechanism for biasing these gears is described in more detail with reference to FIGS. 15(*a*) and (*b*) in the case of the gear 161, as an example. Gears 161, 180 fixed coaxially with each other are rotatably secured at one end of a U-shaped member 93. The member 93, in turn, is rotatably secured at a middle portion thereof on the shaft C of a gear 179 intermeshed with the gear 180. The shaft C is rotatably secured on the bracket 90. At the other end of the member 93 opposite to the gear 91 is provided a pin 94, which extends backward through an aperture 95 of the bracket 90. The spring 80 (also see FIG. 15(*b*)) is hooked at one end thereof to the pin 94 and at the other end thereof to another pin 96 fixed on a lower portion of the bracket 93. According to this mechanism, the gear 161 is always resiliently biased in the arrowed direction in FIG. 14. Similar mechanisms are provided for the gears 151 and 170, and accordingly, these key wheels are firmly intermeshed with the corresponding external gear when the latter is meshed with the former.

Next, an operation of the gear box will be explained below.

Figure 16A:
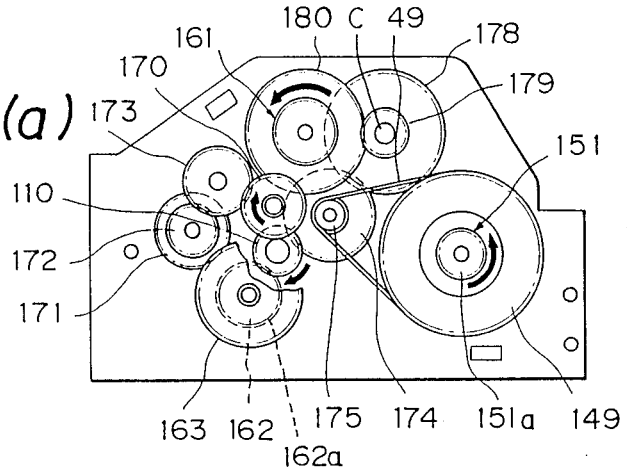
FIGS. 16(*a*) and 16(*b*) are side views of the gear box, illustrating a path of a torque transmission according to the rotational direction of a motor, respectively.
Figure 16B:
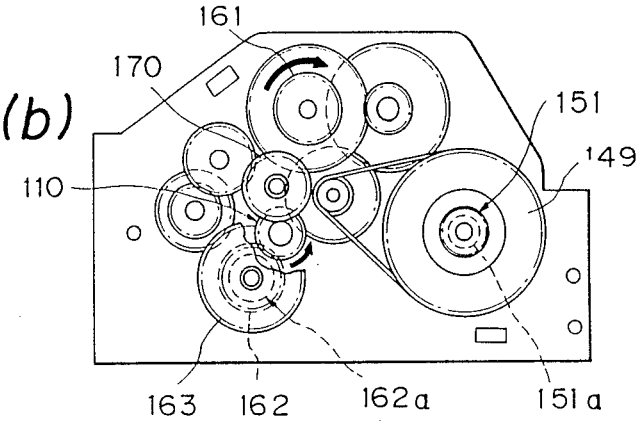

When the motor M rotates clockwise, as shown in FIG. 16(*a*), a torque is transmitted by the motor gear 110, on one hand, to the gear 162, which then is driven counter-clockwise. Accordingly, this rotation is transmitted to the gear 163 by the one-way clutch 162*a*, and sequentially, through a gear train 171, 172, and 173, to the gear 170 which is then driven in the arrowed direction. On the other hand, the rotation of the motor gear 110 drives the gear 161 in the arrowed direction through a gear train 174, 178, 179, 180. Also, the rotation of the motor gear 110 drives the gear 151 in the arrowed direction through a path of the gear 174, a pulley 175, a belt 49, and the pulley 149. Note, a pulley/belt mechanism is used for driving the gear 151 so that the photoconductive drum 5 can be smoothly rotated, resulting in a better printing quality.

When the motor M is rotated counter-clockwise, as shown in FIG. 16(*b*), the gear 162 is driven clockwise and the torque is not transmitted to the gear 163 by the one-way clutch 162*a*. Therefore, the gear 170 downstream from the gear 163 remains stationary. But the rotation of the motor gear 110 is transmitted to the gear 161 through the gear train 174, 178, 179, 180 and drives the same in the arrowed direction (reverse to the case shown in FIG. 16(*a*)). On the other hand, although the pulley 149 is driven in the reverse direction (clockwise) through the aforesaid path, this rotation is not transmitted to the gear 151 which remains stationary, by the one-way clutch 151*a*. Accordingly, the rotating elements in the process cartridge 2 can be driven only when the motor is rotated clockwise, and are not driven when the motor is rotated counter-clockwise. A mechanism for driving the process cartridge 2 is explained in more detail with reference to FIGS. 5, 13 and 17.

Figure 17A:
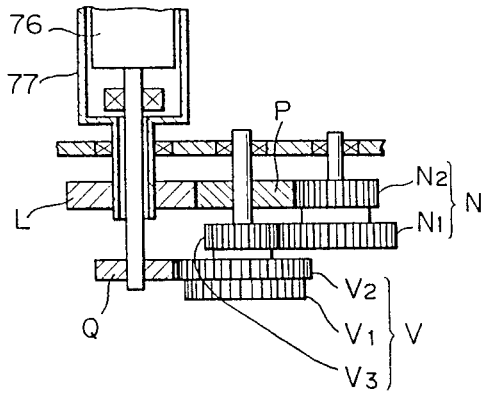
FIG. 17 (*a*) is a plan view of a gear mechanism for driving rotating elements in the process cartridge.
Figure 17B:
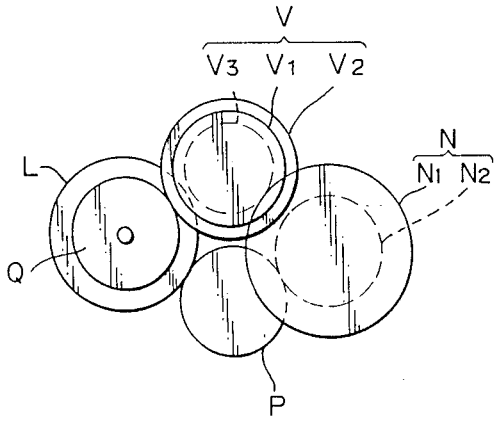

Details of gears L through Q for driving the process cartridge 52 are shown in FIGS. 17(*a*) and (*b*), these gears are also illustrated in FIG. 13(*a*) in a simplified manner. A gear L is fixedly secured at one end of the sleeve 77, and a gear Q is fixedly secured at one end of the magnetic roller 76. A gear V consists of three gears V1, V2, V3 coaxially and integrally fixed with each other and a gear N consists of two gears N1 and N2 also coaxially and integrally fixed with each other. The gear V1 is intermeshed with the gear 170 in the gear box and transmits the rotation thereof through the gear B2 to the gear Q, which then drives the magnetic core 76. The rotation of the gear V2 is transmitted through a gear train V3, N1, N2, P to the gear L, which then drives the sleeve 77. The gears V, N, P are rotatably secured on a side wall of the process cartridge 2. With reference to FIG. 13(*b*), a gear G fixed at the opposite end of the magnetic core 76 is intermeshed with a gear F fixed at one end of a shaft of the agitator 13, to drive the latter.

Next, a description will be given of a gear train arranged in the upper frame 1*b*.

Figure 18:
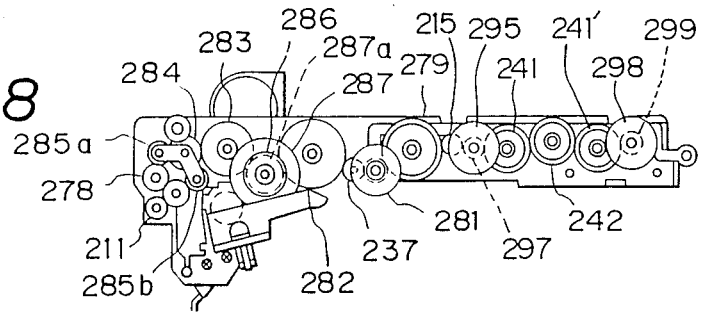
FIG. 18 is a side view of a gear train provided on one side of the upper frame.

With reference to FIG. 18, a gear 281 disposed at a center of the gear train is intermeshed with the gear 161 in the gear box of the lower frame 1*a*.

First, in a path from the gear 161 to the left in FIG. 18, a torque is transmitted through a gear train 237, 282, 286 to a gear 287, which is intermeshed with a gear R (FIG. 11) fixed on a shaft of the heat roller 37 of the fuser unit 4, to drive the same. In this connection, the gears 286 and 287 are secured coaxially with a one-way clutch 287*a* intervened therebetween, which is adapted to transmit only the clockwise rotation of the gear 286 to the gear 287. Accordingly, the heat roller 37 can rotate only counter-clockwise, to forward the cut sheets 25.

Figure 19B:
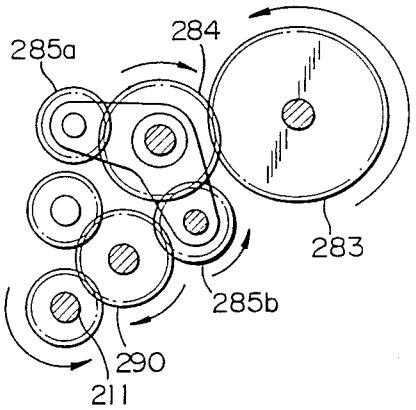
FIGS. 19(*a*) and 19(*b*) are enlarged views, respectively, of part of the gear train of FIG. 18, illustrating a transmission path for driving an eject roller.
Figure 19A:
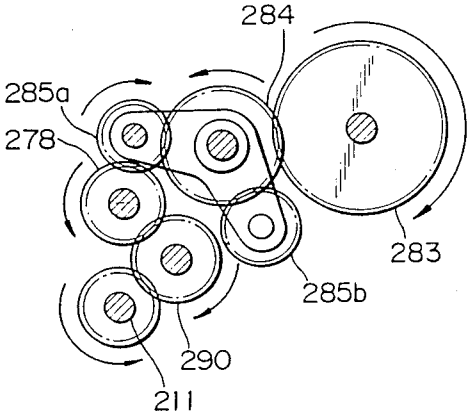

The gear 286 further transmits a torque to a gear 211 for driving the eject roller 39 through a gear train 283, 284, 285*a* or 285*b*, and 278. As shown on an enlarged scale in FIGS. 19(*a*) and (*b*), the gear 285*a* is secured at one end of an L-shaped lever 285 which, in turn, is pivoted about an axis X coaxially with the gear 284. At the other end of the lever 285 is secured a gear 285*b* having the same number of teeth as the gear 285*a*. As shown in FIG. 19(*b*), when the gear 283 is rotated clockwise, the gear 284 is driven counter-clockwise and the lever 285 also pivoted in the same direction, whereby the gear 285*a* is intermeshed with the gear 278 while the other gear 285*b* is free. Consequently, the gear 211 is driven counter-clockwise as shown by an arrow, which corresponds to the running direction of the cut sheets 25. Conversely, as shown in FIG. 19(*b*), when the gear 283 is rotated counter-clockwise, the lever 285 is pivoted clockwise so that the gear 285*b* intermeshed with the gear 290, whereby the gear 211 is still driven counter-clockwise, which is the same direction as before. That is, the eject roller 39 is always made to rotate in one direction even though the rotation of the gear 281 is reversed.

The guide roller 60 is made to rotate by the gear 237.

Figure 20:
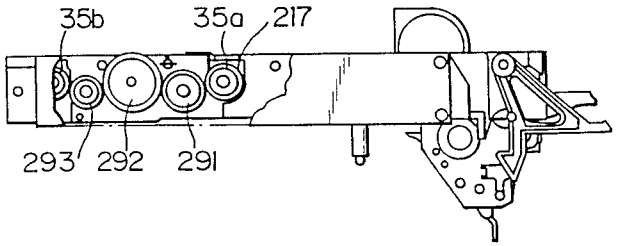
FIG. 20 is a side view of a gear train provided on the other side of the upper frame.
Figure 21:
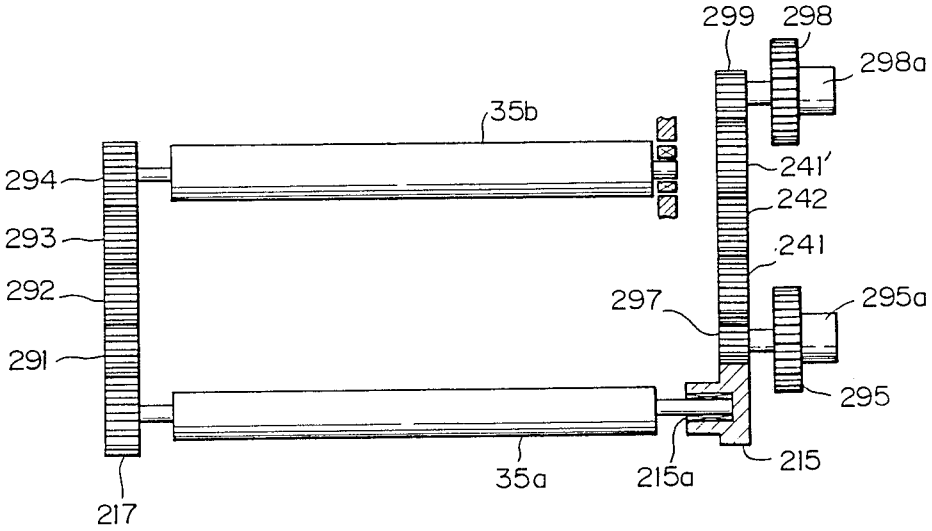
FIG. 21 is a plan view illustrating a gear train for driving a regist roller and a pickup roller.

Next, a transmission path to the right in the Figures will be explained with reference to FIGS. 18, 20, and 21. A torque from the motor M is transmitted to a gear 215 secured at one end of a shaft of the regist roller 6*a* for the first hopper 10*a* via a one-way clutch 215*a*. The one-way clutch 215*a* is adapted to prevent a rotation of the gear 215 in the direction for driving the pickup roller 11 from being transmitted to the regist roller 6*a* but to permit the transmission of the opposite rotation of the gear 215 to the regist roller 6*a* to transport the cut sheets 25. At the opposite end of the regist roller 6*a* is fixed a gear 217, which is associated with a gear 294 fixed at one end of the regist roller 6*b* for the second hopper 10*b* via a gear train 291, 292 and 293. In this structure, both the regist rollers 6*a*, 6*b* are made to rotate simultaneously with each other. A press roller (not shown) for nipping the cut sheets in association with the regist roller 6*a*, 6*b* is provided adjacent to the respective regist rollers 6*a*, 6*b* and is made to rotate by the latter through a gear-engagement therewith.

Figure 22:
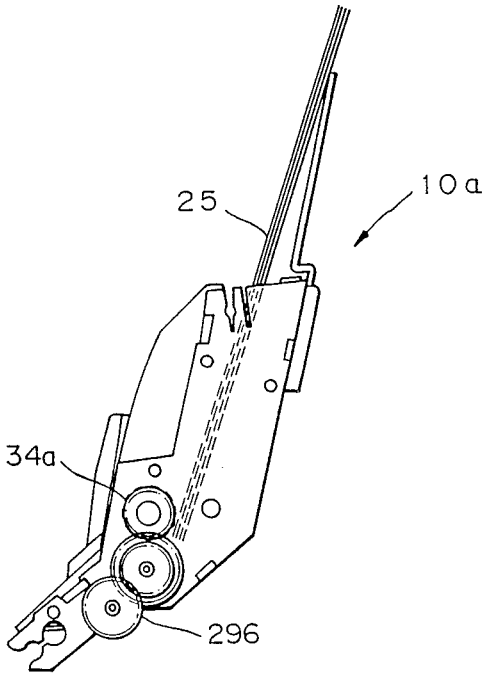
FIG. 22 is a side elevational view of a hopper illustrating a gear secured to and driving the pickup roller.

The gear 215 is also intermeshed with a gear 297 coaxially fixed with a gear 295 having a magnetic clutch 295*a* and is associated with a gear 299 coaxially fixed with a gear 298 having a magnetic clutch 298*a*. The gear 295 is provided for engagement with a hopper gear 296 in the first hopper 10*a*, as shown in FIG. 22, and transmits the rotation to the latter when the magnetic clutch 295*a* is actuated so that the pickup roller 34*a* is made to rotate. In a similar manner, the pickup roller 34*b* in the second hopper 10*b* is driven when the magnetic clutch 298*a* is actuated.

Figure 23A:
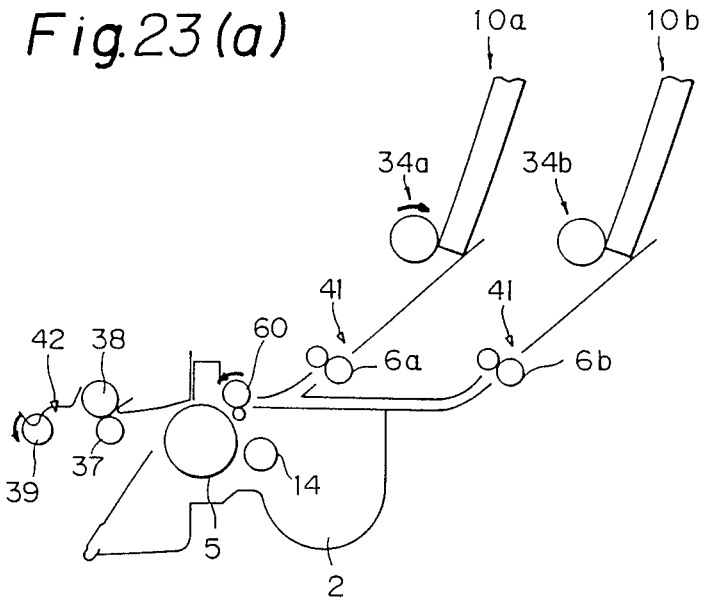
FIGS. 23(*a*) and 23(*b*) are schematic side views, respectively, illustrating the rotational direction of the respective elements in the printer.
Figure 23B:
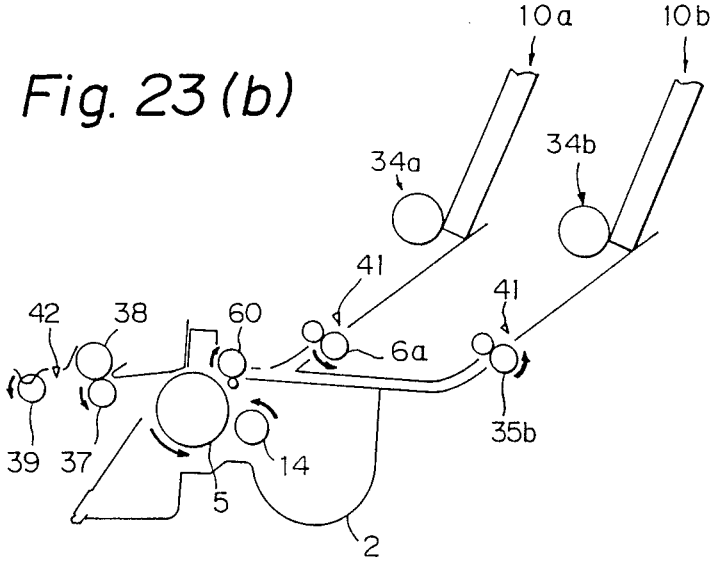

Upon starting the operation of the above-described printer, the selection of the hopper must be made first by actuating one of the magnetic clutches. If the hopper 33*a* is selected, the magnetic clutch 295*a* is actuated so that the transmission path to the hopper 33*a* is formed. Of course, the other magnetic clutch 298*a* is off. Then the motor M is made to rotate in the direction whereby the pickup roller 34*a* is driven to forward the cut sheets 25, as shown in FIG. 23(*a*). When the front edge of the cut sheet 25 is detected by the entry sensor 41, the magnet clutch 295*a* is made off and then the motor M is stopped. When the next command is output, the motor M is rotated in the opposite direction, whereby the rotating elements in the printer other than pickup rollers 34*a* 34*b* are driven in the arrowed direction in FIG. 23(*b*). The cut sheet 25 passes the upper surface of the photoconductive drum 5, and when the rear edge of the cut sheet 25 is detected by the exit sensor 42, the motor is stopped and waits for the command to commence the next printing.

In this connection, although the guide roller 60 rotates with the pickup roller 33 in the reverse direction to the normal operation, as shown in FIG. 23(*a*), this causes no problem because no cut sheets are present in the operation zone of the guide roller 60 at this stage. Further, when the regist roller corresponding to the selected hopper is driven, the other regist roller is rotated therewith, as shown in FIG. 23(*b*), which also causes no problem because the cut sheet 25 is not engaged with the other regist roller at this stage.

As stated above, according to the printer thus described, since a single motor is adopted for driving the respective rotating elements in the printer, and the normal and reverse rotations of the motor are separately used for driving a pickup roller and other rotating elements, respectively, by the intervention of a one-way clutch in a transmission path, the printer has a simple structure and small size.

In addition, the printer housing is a clam-shell type formed by an upper frame and a lower frame, which are detachably connected by a hinge pin. Rollers for running cut sheets are accommodated in the upper frame and a motor and a gear box are accommodated in the lower frame. Thus, when the upper frame is raised and separated from the lower frame, the connection between the rollers and the motor through the gear box is completely cut, so that the rollers can be easily rotated by hand when clearing a jam. Also, the process cartridge can be easily attached to or detached from the printer through an opening formed between the upper and lower frames.

We claim:

1. An image-forming apparatus comprising:

an endless image-carrying body;

means for forming a latent image on said image-carrying body;

a vessel, detachably mounted to said image-forming apparatus, for accommodating a powdery toner therein;

means for developing the latent image formed on said imagecarrying body with the powdery toner delivered from said vessel;

an agitator for stirring the toner in said vessel while driven at a first speed furing a normal developing step;

means for driving said agitator; and means for controlling said driving means to be driven at a second speed slower than the first speed during an initialization process of said apparatus.

2. An image-forming apparatus as defined in claim 1, wherein said initialization process is started by an input of a power source for the apparatus.

3. An image-forming apparatus as defined in claim 1, wherein said initialization process is started by a detection of an insertion of a fresh toner vessel into the apparatus.

4. An image-forming apparatus as define in claim 1, wherein said means for driving said agitator is a pulse motor and a rotational speed thereof is set at a lower level at an initial stage of the operation thereof so that a larger torque is generated to drive said agitator, and is converted to a higher level after a predetermined period has passed.

5. An image-forming apparatus as defined in claim 4, wherein the predetermined period in which the rotational speed of said motor is set at the lower level corresponds to at least one rotation of said agitator.

6. An image-forming apparatus as defined in claim 4, wherein the higher level rotation of said motor is continued until the initialization process of said apparatus is finished.

7. An image-forming apparatus for forming an image on a transfer medium; said apparatus comprising:

a process cartridge detachably mounted to said image-forming apparatus, said process cartridge including at least an endless image carrier, a vessel for accommodating a powdery toner, and an agitator for stirring said toner in said vessel;

means for forming a latent image on said endless image carrier;

means for developing said latent image formed on said endless image carrier with said powdery toner delivered from said vessel;

means for transferring the developed image to said transfer medium;

means for driving said agitator; and means for controlling said driving means so that said agitator is driven at a first speed during a normal developing operation and is driven at a second speed slower than the first speed during an initialization process of said apparatus.

8. An image-forming apparatus as defined in claim 7, wherein said initialization process is started by an input of a power source for the apparatus.

9. An image-forming apparatus as defined in claim 7, wherein said initialization process is started by a detection of an insertion of a fresh toner vessel into the apparatus.

10. An image-forming apparatus as defined in claim 7, wherein said means for developing said latent image is built-in to said process cartridge.

* * * * *